United States Patent [19]

Thayer

[11] 4,164,301

[45] Aug. 14, 1979

[54] SAFETY LOCKING DISPENSER

[76] Inventor: Arnold A. Thayer, 1415 Highland Dr., Logan, Utah 84321

[21] Appl. No.: 818,517

[22] Filed: Jul. 25, 1977

[51] Int. Cl.[2] ..... B65D 85/56

[52] U.S. Cl. ..... 220/253; 220/326; 220/336; 206/534; 206/538; 221/91; 292/84

[58] Field of Search ..... 206/534, 538, 533; 220/256, 255, 253, 336, 345, 324, 326; 116/121; 221/90, 91; 292/87, 84, 88, 89

[56] References Cited

U.S. PATENT DOCUMENTS

| | | | |
|---|---|---|---|
| 148,472 | 3/1874 | Lockwood | 220/253 |
| 1,402,559 | 1/1922 | Wright | 220/336 |
| 1,896,976 | 2/1933 | Schifferdecker | 220/253 |
| 2,078,814 | 4/1937 | Schabacker et al. | 220/336 |
| 2,531,737 | 11/1950 | Lyon, Jr. | 220/346 |
| 2,706,464 | 4/1955 | North | 116/121 |
| 3,313,441 | 4/1967 | Fadden | 206/534 |
| 3,524,564 | 8/1970 | Schorman | 220/324 |

*Primary Examiner*—Joseph Man-Fu Moy
*Attorney, Agent, or Firm*—M. Reid Russell

[57] ABSTRACT

An improved dispenser preferably having seven compartments that are each identified to correspond to a day of the week. The dispenser compartments are formed by partitions arranged within a flat cylindrical housing, the partitions extending outwardly as spokes from a center area thereof, the housing having at least one groove or track formed around a top lip area thereof for accommodating the edge of at least one circular disk that travels therein, said disk either accommodating another disk in an appropriate recess formed therein, or another disk is arranged to travel in a separate groove or track formed also in the housing top lip area, said disks being sandwiched together both having openings formed therethrough that, when aligned, form a passage to allow pills or the like to pass from within the dispenser, the invention including a safety locking arrangement for maintaining the disks together prohibiting alignment of said openings. A number of embodiments of safety locking arrangements for maintaining the disks together are taught by the present invention each embodiment involving a lock that is released by a manual effort that would not be apparent to a child, whereafter the disks can be rotated independently to align their opening to form a passage therethrough.

4 Claims, 6 Drawing Figures

SAFETY LOCKING DISPENSER

BACKGROUND OF THE INVENTION

1. Field of the Invention

This invention relates to a dispenser incorporating a safety locking feature to retard access into compartments therein.

2. Prior Art

Certainly segmented or compartmented containers involving closures for maintaining pills, or the like, are not new. Some examples of such prior art devices involving containers with tops arranged to be moved so as to open a slot or a like passage into the container interior are shown in U.S. Pat. Nos. 173,543; 525,937; 770,485; 928,561; 1,817,562; 2,554,298, 3,020,659 and 3,921,806. Additionally and somewhat similar to the present invention, certain other prior art devices have utilized multiple plates or disks arranged over a housing containing slotted compartments, or the like. Some such devices are shown in U.S. Pat. Nos. 687,358; 1,280,827; 1,994,063; 2,554,710, and 2,953,242.

Some of the above cited prior art United States Patents include features common to the present invention as many of those patents, like the present invention, involve containers having slots, segments, or dividers therein to compartmentalize the container interior, and some involve either single plates or disks or multiple plates or disks that are movable to expose a passage or hole therethrough for allowing items to pass from the container interior through said aligned openings. None of the discovered patents or any like device within my knowledge, however, involve a safety locking arrangement, like the present invention that requires manual manipulation to unlock the arrangement that would not be apparent to a child. The Leccese U.S. Pat. Nos. 2,554,710, does involve, as a lock, a protuberance in one plate that fits within a seat, in another plate, which arrangement, though it appears to be similar to one embodiment of the safety lock of the present invention, does not involve locking of the plates together and is merely for discouraging movement of a rotating plate with respect to a stationary plate.

None of the cited patents, however, involve embodiments of safety locking arrangements that are like those taught by the present invention for restricting access, as by children, into the container interior without performance of certain manual steps thereon. While certain features or elements of the present invention may be shown in the above cited prior art, none of the art discovered, nor any device within the knowledge of the inventor, anticipates the particular type of dispenser of the present invention involving a flat cylinder arranged with disks across a top portion thereof, which disks are moved appropriately to expose a passage therethrough above a particular compartment, and involves a safety lock arrangement for holding the disks together where their respective openings are not aligned. The dispenser is, thereby, maintained in a closed state until certain manual steps are performed to unlock the disks allowing them to be rotated so as to align their openings. The present invention is, therefore, unlike any device within the knowledge of the inventor; and is, therefore, believed tc be both novel and unique.

SUMMARY OF THE INVENTION

The principal object of the present invention is to provide a dispenser arranged with compartments therein, each individual compartment for maintaining pills, or the like, to be dispensed therefrom in correlation to a specific day of the week, month, or the like.

Another object of the present invention is to provide a dispenser having a closure associated therewith that can be aligned over a certain compartment therein, and selectively opened and closed, which closure can be releasably secured so as to prohibit entry.

Another object of the present invention is to provide, as a closure for a compartmentalized dispenser, multiple plates or disks that can be moved over one another to align openings in each to form a passage therethrough above a select compartment, said disks moving independently of one another but can be maintained together by a safety locking arrangement with the openings not aligned to close the dispenser.

Still another object of the present invention is to provide a safety locking arrangement for a compartmentalized dispenser that involves movable plates or disks, the disks arranged to turn independently, aligning openings in each, to provide a passage therethrough, with the safety locking arrangement prohibiting such independent rotation that would align the openings through the disks, absent manual manipulation of a part or parts thereof.

Still another object of the present invention is to provide a dispenser and safety locking arrangement therefor that can be fabricated from inexpensive materials, such as a plastic, by molding or like methods, that is inexpensive to manufacture and is durable.

Principle features of the present invention is a safety locking dispenser include a housing, that is preferably formed as a flat cylinder and has divider walls arranged therein to compartmentalize that flat cylinder. The divider walls preferably radiate outwardly from a center pier, forming pie-shaped compartments, each of which compartments is related to a day of the week, or the like, marked opposite thereto on the outer surface of the flat cylindrical housing. To provide a closure for the housing, a plurality of plates or disks are arranged in tracks to rotate in the housing, proximate to the top thereof, independently of one another to align openings therethrough, the disks or plates being turned manually to align those openings over a selected compartment to allow passage of pills, or the like, therethrough. The lower disk preferably has a ridge or bar formed thereon radiating outwardly from the center thereof and extending upwardly from that lower disk at a normal angle. The bar is adjacent to the opening formed through the lower disk, which opening is approximately the same size as one of the compartments and is approximately the same size as the opening in the upper disk for alignment therewith to form a passage through both disks. The bar extends through the opening in the upper disk and is moved manually across the opening in the upper disk to align therethrough the lower disk opening, forming a passage through which pills, or the like, can pass into or out of the container.

The invention further involves different embodiments of safety locking arrangements for maintaining the upper and lower disks together such that the openings through each are not aligned. One such preferred safety locking arrangement involves a tab secured, as during molding thereof, to the upper disk extending from the side of the opening into that opening, the tab having a tip formed thereon that is arranged to fit into an appropriate opening formed in the lower disk, maintaining the disks together, until the tab is manipulated to lift the tip out of the opening releasing the disks. In another embodiment, the tip of a tab like that described above is arranged to fit over a notch formed in the bar that connects to and extends from the lower disk. In this arrangement the tab tip when moved into engagement with the bar will first be cammed up over the bar, a notch in the tab located behind the tip then lowering over a portion of the bar, locking such that the disks will thereafter turn together. Unlocking of this safety locking arrangement involves lifting the tab notch out of its engagement with the bar, whereafter the disks can be turned independent of one another. Such tab can be arranged normal to the bar as described above or can be arranged parallel to said bar such that the bar will travel under the tab, the tab lowering therebehind. Such tab needs to be arranged to flex freely at its connection with the upper disk returning to its relaxed attitude in the plane of the disk or plate, after passage of the bar thereunder.

Unlocking of the above tab and bar safety locking arrangement can involve an operator manually pressing the bar downwardly to disengage the tab notch and thereafter rotating the one disk independently of the other, or could involve elevating the tab tip and then so rotating the disks.

Another safety lock configuration that could be incorporated as a safety locking arrangement of the present invention could involve having the bar connected to the lower disk so as to be capable of sliding back and forth along its junction with that lower disk such that, when moved into alignment with a notch formed in the upper disk, it can be manually moved into that notch, prohibiting thereafter independent rotation of said disks. Release of this safety lock configuration preferably involves moving the bar out of said notch, whereafter the two disks can be turned independently of one another.

Another embodiment of a safety locking arrangement involves a node or detent formed in the lower disk for alignment and entry into an appropriate opening or hole formed in the upper disk such that, when the node or detent is aligned with that opening it will travel therein locking the disks together. This embodiment would, of course, also involve an arrangement for moving the two disks away from one another, removing the node or detent from the opening or hole, allowing the upper or lower disk to turn independently of the other disk. One such arrangement for providing this movement of the respective disks could involve a button or collar arranged in the center of the lower disk to extend upperwardly therefrom through an appropriate opening in the upper disk such that an operator, by pushing downwardly on that button, can cause the two disks to be moved apart. Obviously, this embodiment necessarily involves some spring means or depends upon the natural resiliency of the disk material whereby the one disk can be flexed away from the other without displacing the edges thereof from the grooves or notches in the container sides wherein said disk or disks ride.

Further objects and features of the present invention will become apparent from the following detailed description taken together with the accompanying drawings.

THE DRAWINGS

FIG. 1 is a top plan perspective view of the safety locking dispenser of the present invention showing upper and lower disks thereof arranged in a closed attitude;

FIG. 2, a top plan view of the safety locking dispenser of FIG. 1, showing, in broken lines, compartments formed therein with, Arrow A showing the direction of rotation of the lower disk after unlocking from the upper disk to open a passage therethrough above one of the dispenser compartments;

FIG. 3, a top plan perspective view like that of FIG. 1, only showing the upper and lower disks exploded away from the safety locking dispenser body;

FIG. 4, a profile sectional view taken along the line 4—4 of FIG. 3, showing a first embodiment of a safety lock, for the safety locking dispenser of FIGS. 1 through 3;

FIG. 5, a profile sectional view of a second embodiment of a dispenser that is like the dispenser of FIGS. 1 through 3, but employs a different configuration of safety lock; and FIG. 6(*a*) through (*c*), additional embodiments of safety locks for use with the dispenser of FIGS. 1 through 3, or like dispenser.

DETAILED DESCRIPTION

Figure 1:
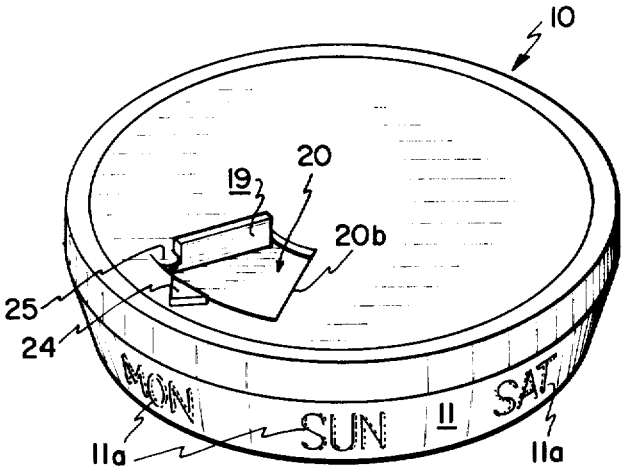
Figure 2:
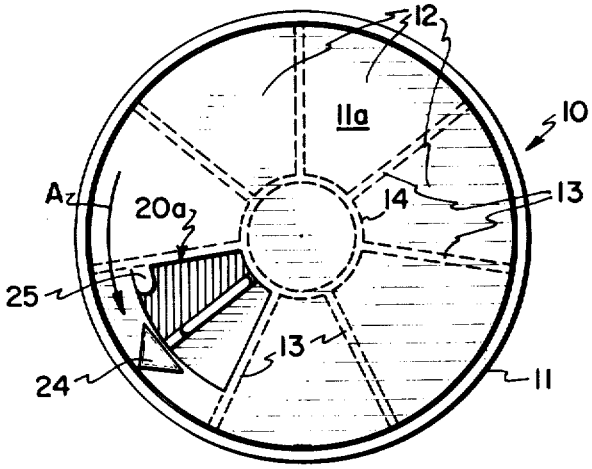
Figure 3:
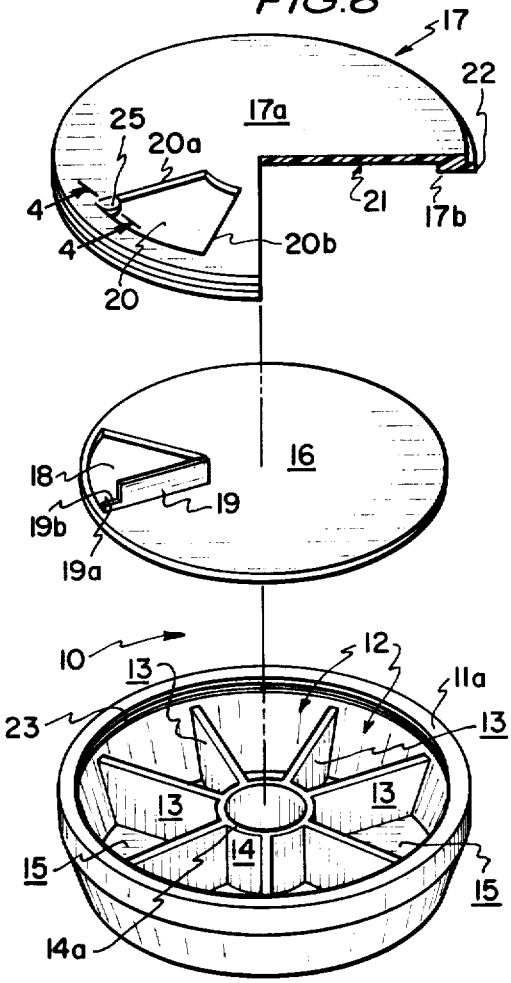

Referring now to the drawing:

In FIG. 1 through 3 are shown a first embodiment of a safety locking dispenser 10, hereinafter referred to as dispenser, that includes a flat cylindrical housing 11 wherein are shown formed seven compartments 12. Compartments 12 are formed by walls 13 that extend upwardly from the housing bottom 15 and radiate as spokes from a center hub 14. As shown best in FIG. 3, center hub 14 is also cylindrical and extends upwardly from the housing bottom 15. The center hub 14 is shown in FIG. 2 as being open therethrough such that an operator, not shown, may have access, as with his finger, pencil, or the like, to the undersurface of a disk or plate arranged across the top of housing 11, the function of which disk or plate will be explained later herein.

As shown in FIG. 1, lettering 11*a* is arranged around the outer wall of housing 11 spelling out the days of the week in three-letter abbreviations, which letters should be taken as being arranged immediately opposite to an individual compartment 12. Each compartment 12, therefore, is identifiable with a particular day of the week and is intended to receive pills, or the like, therein for storage and later dispensing, as will be explained later herein. Obviously, the dispenser 10 could be arranged with a greater or lesser number of compartments 12, which compartments could be identified differently than as representing days of the week, without departing from the subject matter coming within the scope of this disclosure.

Shown best in FIG. 3, are arranged a lower disk or plate 16 and an upper disk or plate 17 sandwiched thereover hereinafter referred to as disks. FIG. 3 shows upper disk 17 as having had a section removed therefrom to expose a cross section of that disk, identifying it as being preferably fabricated from a plastic. As with upper disk 17, the entire dispenser 10 is intended to be manufactured from a plastic, or like material, by molding, or like methods, and, therefore, should be inexpensive to manufacture.

Again, with reference to FIG. 3, lower disk 16 has an opening 18 formed therethrough that should be taken as being essentially the size and shape of one of the compartments 12. Along one edge of that opening is shown arranged a bar 19 secured to that lower disk 16, along one side of opening 18 extending normal to lower disk 16. The bar 19, proximate to the outer edge of the disk 16, is shown as having had a notch 19a removed therefrom. Bar 19 extends upwardly from the lower disk for installation through an opening 20 that is essentially like opening 18, and includes the area of bar 19 and is formed in the upper disk 17. So installed, bar 19 can be moved across opening 20, turning lower disk 16 appropriately by an operator, not shown, as with his finger pushing against the sides of that bar. So arranged, bar 19 will act against the sides 20a and 20b, of the opening 20, to turn together the upper and lower disks 16 and 17, as shown by arrow A in FIG. 2.

Upper disk 17, as shown in FIG. 3, is preferably formed having a flat top surface 17a with the lower surface 17b thereof, preferably having a recess 21 formed therein for receiving the lower disk 16. Upper disk 17 also has a ridge 22 formed around its outer circumference for installation in a continuous groove 23 that is formed around the top of housing 11. Groove 23 provides a track wherein ridge 22 travels. When lower disk 16 is installed in recess 21, the bottom thereof, at the center, is proximate to the top 14a of center hub 14, and will support the lower disk 16 to rotate freely therein. The limit of travel of lower disk 16 is the distance across the opening 20, bar 19 contacting either of the sides 20a and 20b, whereafter both upper and lower disks 16 and 17 are moved together. With ridge 22 of the upper disk edge 17 riding in the groove 23 and the under surface of lower disk 16, at the center thereof, riding on the top 14a of the center hub 14, the disks enjoy a freedom of rotation of 360°, and by appropriately moving the disks, openings 20 and 18 will align to form a passage therethrough. So arranged, selective access to compartments 15 is provided by the appropriate rotation of bar 19 to so move the upper and lower disks 16 and 17. To assist in aligning the openings 18 and 20 to a selected compartment 15, an arrow 24, shown best in FIGS. 1 and 2, is arranged on the upper disk 17, central to the opening 20, for pointing to a particular day of the week 11a arranged on the housing 11 outer surface.

Figure 4:
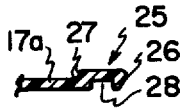

To provide a safety locking arrangement for dispenser 10, as shown in FIGS. 1 through 3, a tab 25 is arranged with upper disk 17, that has an end thereof secured so as to extend from the side 20a of opening 20 into that opening in the plane of the disk. So arranged, an operator by moving, as described, bar 19 of the lower plate 16 into engagement with opening side 20a, a tip 26 of tab 25, shown in FIG. 4, will be cammed up and over a ridge or ledge 19b of bar 19, shown in FIG. 3, which ridge 19b is left as remainder when notch 19a is removed from bar 19. In practice, shown in FIG. 4, ridge 19b engages a slanted portion of tip 26 of the tab 25, the ridge riding over the slanted portion, camming the tab upperwardly. Tab 25 is thereby bent at a reinforced section 27 thereof until ridge 19b, of FIG. 3, aligns with a notch 28, of FIG. 4, formed in the tab 25 whereupon that notch 28 lowers over the ridge 19b, locking the tab 25 and bar 19 together. With tab 25 locked to the ridge 19b of bar 19, openings 20 and 18, respectively, in the upper and lower disks 17 and 16, are not aligned prohibiting entry into or exit from the dispenser 10.

To open the dispenser 10 an operator, not shown, while holding disk 17 stationary can, with his thumb, press downwardly and across opening 20 on bar 19 thus forcing tab 25 to flex upwardly as bar 19 moves downwardly allowing notch 28 of tab 25 to pass out of ridge 19b of bar 19. Once ridge 19b is thus freed from notch 28, bar 19 may be moved across opening 20 to contact side 20b which action will serve to align opening 20 in upper disk 17 with opening 18 in lower disk 16 to allow for passage therethrough into any selected compartment 15 in housing 11.

Another method for opening dispenser 10 could involve an operator, not shown, using his fingernail, or the like, to lift that tab 25 a tip 26 so as to elevate notch 28 out of engagement with bar ridge 19b, with bar 19 thereafter being moved as with another finger, from its engagement with side 20a across opening 20 to contact side 20b, in which attitude, as shown in FIG. 2, openings 20 and 18 are aligned to form a passage therethrough.

Either before or after opening, as described above, an operator by manually pushing against bar 19 can align arrow 24 to a desired day 11a, thereby aligning the passage through disks 16 and 17 with the selected compartment. Obviously, with tab 25 maintained to ridge 19b the plates 17 and 16 are held together and can be rotated freely, with this locking to continue until an operator, as described above, manually releases the lock of tab 25 to bar 19.

It is intended that tab 25 be formed as part of upper disk 17 and can be, if desired, and as needed, reinforced at 27 as with providing added plastic thereto. The hinge arrangement of tab 25 at 27 with upper disk 17 is thereby a living hinge that is capable of numerous flexures without the material thereat breaking down and facturing. Tab 25 provides for a safety locking of the upper and lower disks 17 and 16 prohibiting, or at least making difficult, a child's unwanted access into the dispenser 10.

Figure 5:
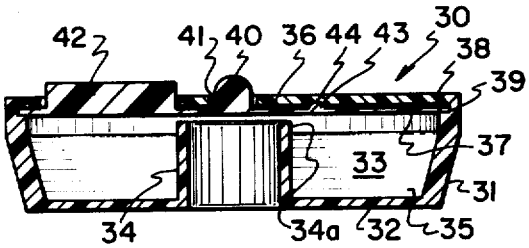

The above description of the tab 25, its living hinge 27 portion thereof, and its operation with bar 19 constitutes a first preferred embodiment of a safety lock for a dispenser 10. In FIG. 5 is shown a second embodiment of a safety locking dispenser 30, which dispenser also involves a flat cylindrical housing 31, which housing is essentially like the described housing 11. In housing 31 are shown in FIG. 5, walls 33 that radiate outwardly from a cylindrical center hub 34 that extends upwardly from a housing bottom 32 forming thereby compartments 35. Compartments 35 like the described compartments 12, preferably relate to days of the week. Like the arrow 24 of dispenser 10, on an upper disk 36 of dispenser 30, can be included an arrow or pointer. Unlike dispenser 10, dispenser 30 involves upper and lower disks or plates 36 and 37, hereinafter referred to as disks, that are independent of one another, the edges of each being fitted into, respectively, upper and lower grooves 38 and 39 formed around the inside, proximate to the top, of housing 31 or, of course, both edges could be arranged in one groove. The disks are thereby independent of one another. To provide for safety lock of dispenser 30, a button 40 that extends upwardly is arranged in the center of lower disk 37, the button passing through a center hole 41 formed through upper disk 36 to move freely up and down therein. So arranged, a bar 42, that is essentially like the described bar 19, excepting it does not have a notch 19a removed therefrom, is arranged on lower disk 37 to extend through an opening in upper plate to turn between and engage opposite sides thereof for turning simultaneously both disks 36 and 37. Also, like lower disk 16 with opening 18 of dispenser 10, the lower disk 17 of this embodiment should be understood to have an opening formed therethrough that is approximately the same size and shape as one of the compartments 35. When the openings in disks 36 and 37 are aligned, a passage is formed into the dispenser. Essentially, the functioning of dispenser 30 is like that of the described dispenser 10, as relating to movement of the upper and lower disks. Safety locking of said disks is, however, different and involves button 40 that extends, as stated above, through hole 41 parallel to a bar 42, as shown in FIG. 5, and normal to lower disk 37. Further, lower disk 37 also has a protuberance 43 formed thereto that extends outwardly therefrom in the place of both the bar 42 and button 40, for fitting or passing into a depression 44 formed in or through the undersurface of upper disk 36, to lock the disks together. The locked together disks can be rotated by an operator, not shown who pushes appropriately with his finger on bar 42.

With the disks 36 and 37 so locked together, the openings therethrough are not aligned, denying entry into a compartment 35. To unlock the dispenser 30 the lower disk needs to be moved apart from the upper disk. An operator, to so move the disks out of engagement, manually depresses button 40 to flex the lower disk 37 downwardly, away from upper disk 36, removing protuberance 43 out from opening 44, whereafter by manually operating bar 42, the lower plate can be moved independent of the upper disk so as to align the openings therethrough. It is intended that lower disk 37 be fabricated from a material such as a plastic having sufficient flexure characteristics to allow it to bend sufficiently to remove the protuberance 43 out from the opening 44, without the lower disk 37 edge passing out of a groove 39 formed around the top of housing 31. The top 34*a* of the hub 34 acts as a break or stop against a depression of disk 37 that would be sufficient to move lower disk 37 edge out of the groove 39.

Obviously, like dispenser 10, dispenser 30 is also preferably manufactured by commonly known and available molding methods, or the like, from a plastic or plastic-like material, such that it will be inexpensive to manufacture.

Also, it should be obvious that, while the proturberance 43 is shown as formed on the lower disk 37 and with the opening 44 formed in the upper disk 44, the location of those items could be reversed without departing from the present disclosure.

Figure 6:
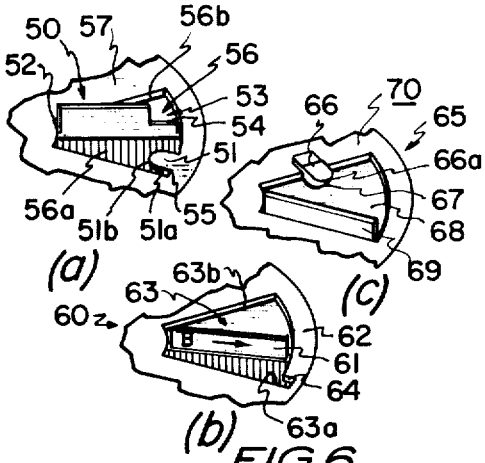

In FIG. 6(*a*) through (*c*) are shown alternative embodiments of safety locking arrangements, preferably for use with a dispenser similar to dispenser 10. These safety locks, like the tab 25 described with respect to dispenser 10, are each intended to join upper and lower disks of a dispenser to prohibit alignment of openings or holes through those disks into the dispenser interior. Therefore, when describing these safety locking embodiments, they should be taken as being preferably useful with dispenser 10.

Like the described tab 25, the safety lock 50 of FIG. 6(*a*) involves a tab 51, that has a tip 51*b* end thereof that is arranged to pass over a notch 53 formed in a bar 52. Tab 51, however, unlike tab 25, lies in the plane of a ridge 54 formed in bar 52. In practice, tab 51 will cam upwardly over the ridge 54, the ridge passing thereunder, with tab 51 thereafter lowering behind the bar 52, the bar being maintained in an opening 55 that is formed between a side 51*a* of the tab and a side 56*a* of an opening 56 formed through an upper disk 57. Upper disk 57, it should be taken, is essentially like the upper disk 17 of dispenser 10. Unlocking of safety lock 50 is provided when tab 51 is moved away from ridge 54, allowing ridge 54 to pass thereunder into opening 56.

Tab 51 when arranged behind the bar 52 will prohibit a rotation of the bar and the lower disk, to which disk the bar is connected, providing a locked attitude where the upper and lower disks thereafter rotate together and openings therethrough are not aligned. When the tab 51 is unlocked, as described above, bar 52 can be moved across opening 56, to engage an opposite opening wall 56*b*, in which attitude openings in the upper and lower disks, not shown, are aligned to form a passage therethrough into the dispenser interior.

Like the safety locks hereinbefore described, safety lock 60, shown in FIG. 6(*b*), also involves a bar 61 arranged on a lower disk that is moved to rotate that disk, the bar traveling across an opening 63 formed through upper disk 62 to contact a side 63*b* thereof, exposing a passage formed by openings arranged through upper disk 62 and the lower disk. Where the previous embodiments of safety locks have involved stationary bars, in this embodiment the bar 61, along its side that engages the lower disk, has a track or groove arranged therein, not shown, for coupling, in sliding engagement with, an opposite groove or track formed in said lower disk, such that, when the bar is slid appropriately as shown by arrow B, it can be moved into a groove 64 that is arranged in the upper disk 62 adjacent and aligned with side 63*a* of opening 63. When so moved by an operator, not shown, bar 61 is thereby locked within the groove 64 securing the upper and lower disks together until the bar is removed therefrom. Unlocking of this safety lock 60 requires moving bar 61 opposite to the direction of arrow B until it clears groove 64, whereafter the upper and lower disks are free to rotate independently of one another. This embodiment of safety lock 60, it should be understood, performs the same function as do the other safety locking arrangements already described herein, in relation to the described upper and lower disks.

Another embodiment of a safety lock 65 is shown in FIG. 6(*c*). Safety lock 65 is also useful with dispensers having upper and lower rotating disks as lids therefore, like the disks shown and described with respect to dispenser 10, and, like that dispenser, also involves a tab identified in FIG. 6(*c*) as tab 66. Tab 66, like tab 25, also involves a living hinge and has a nodule 66*a* formed thereon that is intended to fit within an opening or seat 67 formed in the lower disk 68, which lower disk also has a bar 69 extending upwardly therefrom. In this embodiment tab 66 is secured to upper disk 70 so as to be capable of being lifted, as by an operator's using his finger, not shown, to lift the nodule 66*a* portion thereof out from seat 67 thereby releasing lower disk 68 such that it will rotate independently of upper disk 70. To reinstall the lock, the lower disk is moved appropriately until the nodule 66*a* end of tab 66 is aligned with and is lowered by its living hinge into seat 67.

As stated earlier herein, it is preferred to manufacture the dispensers 10 or 30, with one of the safety locking arrangements disclosed herein, by conventional molding methods, or the like, from a resilient material, preferably a plastic, that is capable of being bent but will return to its original attitude, particularly at a living hinge portion of a safety lock, as described. Certainly, while plastic is the preferred material for use in manufacturing the present invention, other materials could be so used and manufacturing methods other than molding could also be used without departing from the scope of this disclosure. Further, while seven compartments, each representing a day of a week, have been shown as being preferred compartment arrangements within the dispenser, it should be obvious that other numbers of compartments, representing other periods could be so incorporated, without departure from the scope of this disclosure. Also, while a number of configurations of safety locking arrangements have disclosed herein as preferred embodiments, it should be apparent that other types of arrangements for releasably maintaining upper and lower disks in a fixed attitude for closing of a dispenser, and therefore, like or similar arrangements to those disclosed, that perform the same function, would be within the scope of the present disclosure. Also, while a bar has been shown herein to be a preferred configuration for allowing an operator to move the described disks, obviously other configurations or components, for attachment to either the upper or lower disks, for moving those disks together, could be employed without departing from the scope of present disclosure.

While preferred embodiments of the present invention have been shown and described herein, it should be understood that variations, changes, adaptations, modifications and the like may be made without departing from the subject matter coming within the spirit and scope of the present disclosure, which subject matter is covered by the following claims, which claims I regard as my invention.

I claim:

1. A safety locking dispenser comprising, a cylindrical housing that is closed across the bottom thereof;

a plurality of upstanding walls within said cylindrical housing, separating the interior thereof into compartments;

an upper disk means fitted at the edge thereof in a track formed in said cylindrical housing, for closing off the top thereof, so as to rotate therein, having an opening formed therethrough;

a lower disk means arranged within said cylindrical housing, below said upper disk, for closing off the top thereof so as to rotate independently of said upper disk, and having an opening formed therethrough that is similar to said opening formed through said upper disk;

means for releasably locking said upper and lower disks together consisting of, a tab secured at one end thereof to the upper disk so as to extend in the plane thereof and to be capable of upward flexure therefrom; said tab having a notch removed therefrom, proximate to its opposite end facing oppositely to the top of said upper disk; and a bar attached to said lower disk, arranged to extend upwardly therefrom extending through the opening in said upper disk, which bar has a notch removed therefrom leaving a ridge that receives said tab notch thereover.

2. A safety locking dispenser as recited in claim 1, further including letters indicating defined periods, scribed on the outer surface of the cylindrical housing, immediately opposite to select compartments therein;

pointer means associated with the upper disk for alignment with certain of said letters for aligning the opening in the upper disk with a selected compartment; and means for maintaining, in independent proximity, the lower and upper disks.

3. A safety locking dispenser as recited in claim 2 wherein the means for maintaining, in independent proximity, the lower and upper disks, consists of, a hub formed within the cylindrical housing supporting said lower disk.

4. A safety lock for a dispenser that utilizes, for a closure, overlapping disks that are independently movable to align openings in each consisting of, a tab secured at one end to an upper disk so as to extend in the plane thereof into an opening formed therethrough, which tab is capable of upward flexure therewith, and has a notch removed therefrom, proximate to its opposite end facing oppositely to a top of an upper disk; and coupling means associated with said lower disk for receiving and releasably securing said tab notch thereover;

said coupling means consisting of a bar attached to said lower disk, arranged to extend upwardly therefrom extending through the opening in said upper disk, which bar has a notch removed therefrom leaving a ridge that receives said tab notch thereover.

* * * * *